United States Patent [19]

Jameson

[11] Patent Number: 4,959,183

[45] Date of Patent: Sep. 25, 1990

[54] AERATION APPARATUS

[76] Inventor: Graeme J. Jameson, 34 Curzon Rd., New Lambton, Australia, NSW 2305

[21] Appl. No.: 443,068

[22] Filed: Nov. 28, 1989

Related U.S. Application Data

[63] Continuation of Ser. No. 132,935, Dec. 15, 1987, abandoned.

[30] Foreign Application Priority Data

Dec. 16, 1986 [AU] Australia ..... PH09531

[51] Int. Cl.[5] ..... B03D 1/16

[52] U.S. Cl. ..... 261/87; 210/219; 210/221.1; 209/169; 366/102

[58] Field of Search ..... 209/168, 169, 170; 210/208, 219, 221.1; 366/102, 169, 264; 261/87

[56] References Cited

U.S. PATENT DOCUMENTS

| | | | |
|---|---|---|---|
| 2,055,065 | 9/1936 | Booth | 209/169 |
| 2,085,947 | 7/1937 | Booth | 261/93 |
| 2,182,442 | 12/1939 | Booth | 209/169 |
| 2,944,802 | 7/1960 | Daman | 261/87 |
| 3,882,016 | 5/1975 | Green | 209/169 |
| 4,078,026 | 3/1978 | Fallenius | 209/169 |
| 4,548,765 | 10/1985 | Hultholm | 209/169 |
| 4,551,285 | 11/1985 | Jackson | 209/169 |
| 4,624,777 | 11/1986 | Kallionnen | 209/169 |

FOREIGN PATENT DOCUMENTS

| | | | |
|---|---|---|---|
| 933120 | 6/1982 | U.S.S.R. | 209/169 |
| 1058623 | 12/1983 | U.S.S.R. | 209/169 |
| 1247092 | 7/1986 | U.S.S.R. | 209/169 |

*Primary Examiner*—David L. Lacey
*Assistant Examiner*—Thomas M. Lithgow
*Attorney, Agent, or Firm*—Ostrolenk, Faber, Gerb & Soffen

[57] ABSTRACT

Aeration apparatus for use in recovering values from slurries in a flotation cell wherein the impeller has a plurality of blades extending generally radially and downwardly on its lower surface, each blade extending from the hollow drive shaft of the rotor to the periphery of the impeller and generally increasing in height radially outwardly along the length of the blade. In the preferred form of the invention a stator is provided having corresponding radial blades located beneath the impeller.

8 Claims, 3 Drawing Sheets

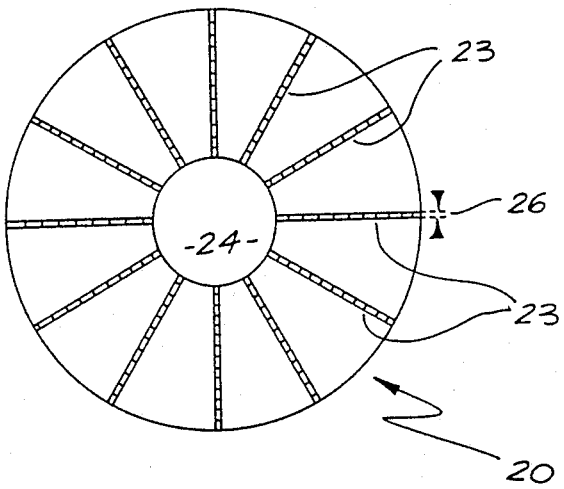
FIG. 3
FIG. 4
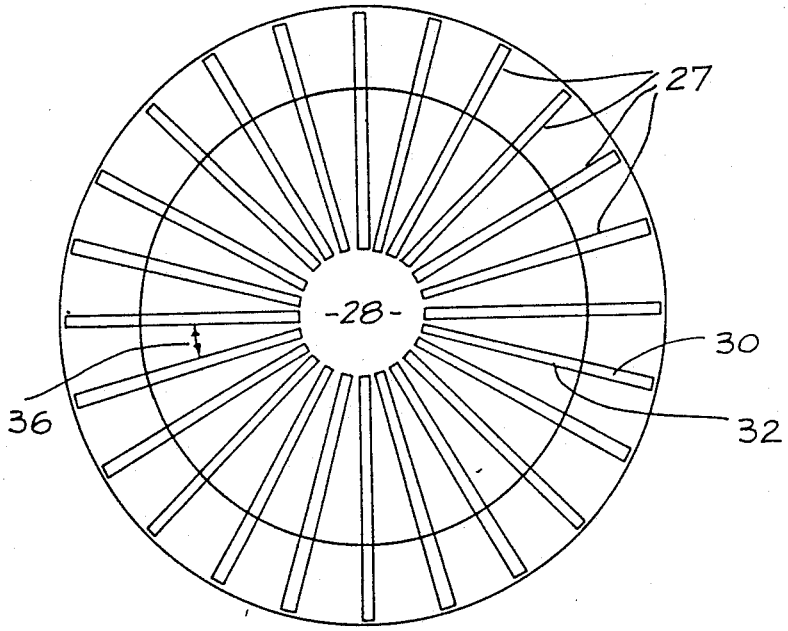

AERATION APPARATUS

This is a Continuation of Application Ser. No. 07/132,935 filed on Dec. 15, 1987 now abandoned.

BACKGROUND OF THE INVENTION

This invention relates to aeration apparatus and more particularly to an improved apparatus for the production of small gas bubbles in a liquid in order to create a large interfacial area between the gas and the liquid, thereby increasing the efficiency of processes such as flotation and gas liquid mass transfer.

Although the apparatus may be of value in other fields such as aeration and gas absorption, the invention will be described in relation to the flotation process.

The art of flotation generally involves the aeration and agitation of a slurry or suspension in water of finely divided ore particles in a cell or apparatus of suitable design. The mineral may be regarded as a mixture of valuable minerals or "values", and clay, rock or other unwanted "gangue" particles. The object of the process is to remove the values from the gangue, and this may be achieved by conditioning the slurry with chemical reagents which have the effect of rendering the values selectively hydrophobic or water repellent, while leaving the gangue particles hydrophilic or wettable. Thus when a hydrophobic particle comes into contact with a bubble, it will attach and rise with it to the surface of the liquid where it forms a froth which may be scraped off into a launder, thereby conveying the values out of the cell and separating them from the gangue, which remains with the liquid in the cell. To assist in the formation of a stable froth, it may be necessary to add chemical frothing agents.

Flotation machines as customarily constructed consist of a tank in the base of which is an aerating rotor and a concentric stator. Air is introduced into the vicinity of the rotor which rotates on a suitably placed shaft, and is broken up into small bubbles by the action of blades or fingers mounted on the rotor, which is frequently of a disc formation. The rotor provides the additional function of keeping the mineral particles in suspension.

Since the valuable mineral is removed from the cell at the surface of the gas bubbles, it is evident that the rate of removal of the particles will depend on the total gas-liquid interfacial area produced in the cell. Thus for a given rate of introduction of air, the smaller the gas bubbles produced by the rotor, the greater will be the interfacial area and hence the more efficient will be the removal process.

The need for more efficient flotation of mineral particles, especially of fine particles smaller than ten microns in diameter, has become more evident in recent times with the depletion of easily worked mineral deposits around the world. It is increasingly found that when new deposits are exploited, the ores are complex and require fine grinding to release the individual mineral particles. Further, in existing mineral concentrators there is a need to improve the recovery of fine particles which hitherto had been allowed to go to tailings, in order to improve the economic performance of the mine.

It is therefore desirable to provide a flotation mechanism which can divide large quantities of gas into very small bubbles to achieve high metallurgical efficiency, while at the same time providing sufficient agitation to maintain the solids in suspension and yet produce a relatively calm surface between the froth layer and the slurry in the flotation cell.

The mechanism should also satisfy practical requirements such as simplicity of construction and operation, long life, easy maintenance and repair, and should be able to be made of wear-resistant and corrosion-resistant materials.

SUMMARY OF THE INVENTION

The present invention therefore provides aeration apparatus of the type comprising a rotor mounted at the lower end of a hollow drive shaft, adapted to be immersed in a liquid with the drive shaft extending substantially vertically upwardly from the rotor, the rotor comprising a disc located in a plane at right angles to the axis of the shaft and having a plurality of blades depending downwardly from the lower face of the disc, the interior of the hollow drive shaft opening to the area beneath the disc such that when the rotor is rotated in a liquid by the drive shaft, and air is forced down the hollow drive shaft to issue on the underside of the rotor, the air being broken up into bubbles by the blades on the rotor, characterised by the configuration of the blades extending outwardly from the shaft on the underside of the disc from a point adjacent the shaft to the periphery of the disc, and the height of the blades generally increasing with distance from the shaft over at least a significant proportion of the radius of the disc.

Preferably the height of each blade is determined at any point along the length of the blade in conjuction with the desired speed of rotation of the rotor to give a bubble size in the range of 100 to 500 $\mu$m.

Preferably the height of the blade, at least toward the outer edge of the disc, is determined by the formula:

$$d_b = \frac{11.89}{U}\left(\frac{\gamma\mu \cdot 2h}{\rho^2 (1 + C_p)}\right)^{\frac{1}{3}}$$

where $d_b$ is the desired bubble diameter U is the velocity of the blade through the liquid, generally equal to 2 $\pi$Nr where N is the rotational frequency of the rotor in c.p.s. and r is the greatest radius of the blade.

$\gamma$ is the surface tension of the liquid.

$\mu$ is the viscosity of the liquid.

h is the height of the blade.

$\rho$ is the density of the liquid.

$C_p$ is the drag coefficient on the blade (generally having a value of 1 to 2).

Preferably the aeration apparatus further comprises a stator mounted adjacent the rotor and incorporating a plurality of substantially vertical blades extending radially outwardly from an area beneath the opening from the hollow drive shaft of the rotor.

Preferably the upper edges of the stator blades correspond with the profile of the lower edges of the rotor blades and are spaced a predetermined distance therebelow.

Preferably the number and thickness of the stator blades approximate the number and thickness of the rotor blades.

Preferably the stator blades extend radially outwardly beyond the periphery of the rotor, and extend upwardly beyond the outer ends of the rotor blades.

Preferably the aeration apparatus is incorporated in an improved flotation cell having a-rotor-stator pump assembly submerged in a slurry and in which a rotor body comprises plate and blade members for dispersing gas in the pumped slurry. A gas stream which is conveyed to the rotor is entrained into a trailing surface of each rotating blade where it is dispersed in the slurry.

Preferably the flotation cell comprises a vessel for supporting the slurry, a rotor-stator pump assembly positioned in the vessel beneath the slurry surface, a depending support means for supporting the rotor body within a cavity formed by the stator means for supporting the stator, means for causing rotation of the rotor body in the vessel, means for conveying gaseous fluid below the slurry surface to the rotor body for dispersal in the slurry, means for introducing a slurry to the vessel, means for removing a froth from the surface of the slurry, and means for removing the slurry from the vessel. The rotor body includes a top plate member and a plurality of blade members extending transversely from the axis of the rotor.

DESCRIPTION OF THE DRAWINGS

Notwithstanding any other forms that may fall within its scope, one preferred form of the invention will now be described by way of example only with reference to the accompanying drawings, in which:

FIG. 3 is a plan view of the rotor and blades taken on a line 1—1 of FIG. 2;

FIG. 4 is a plan view of the stator of the aeration apparatus shown in FIG. 1.

DESCRIPTION OF THE PREFERRED EMBODIMENT

Figure 1:
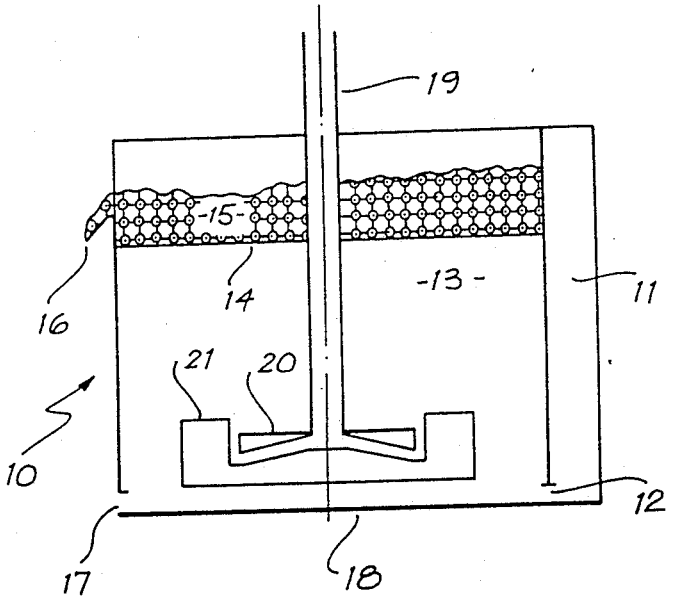
FIG. 1 is a sectional elevation of one form of flotation separation apparatus incorporating aeration apparatus according to the invention.

FIG. 1 shows a general view of a flotation cell generally designated as 10. The suitably conditioned mineral slurry enters a feed box 11 and thence through an opening 12 into the body 13 of the cell itself where it is contacted with air bubbles. The bubbles carrying the floatable particles rise to the top of the slurry 14 to form a layer of froth 15 which then flows over a lip 16 into a suitably placed launder as the concentrate. The remainder of the slurry leaves the cell through an opening 17 as the tailings. The form of the cell 10 may be square, rectangular or cylindrical, and the base 18 may be flat, curved, hemispherical or U-shaped. The gas is introduced through the hollow shaft or spindle 19 which also acts as the driving shaft for the rotor 20. The shaft 19 is supported by a suitable mounting system containing also a means for introducing the air into the rotating shaft, and for driving the shaft at the desired rotational speed, none of which is shown.

At the lower end of the hollow shaft 19 is attached a rotor 20 which rotates within a stator 21. The rotor exerts a pumping action on the contents of the cell and serves to break up the air flow into a multitude of small bubbles. The stator reduces the swirling motion of the liquid both before and after it passes through the rotor.

The rotor (FIGS. 2, 3) comprises a top plate or disc 22 from which depends a plurality of blades 23. The disc 22 is attached to the lower end of the hollow shaft 19 by a bolted flange or other suitable means, and contains a central co-axial opening 24 to allow air to pass from the shaft to the blades 23.

The blades 23 extend radially outwardly from the opening 24 to the periphery of the disc, although curved (backward- or forward-facing with respect to the rotation direction) blades may also be used with varying effects on the pumping capacity of the rotor. The straight blade has advantages for simplicity of construction. It is also possible for the blade to be discontinuous over its length, i.e. to incorporate a number of vertical cuts or slots in the blade or other holes or apertures therethrough. Such variations will not detract from the overall performance of the blade, but it is generally felt to be simpler to form the blade as a straight and continuous blade.

Figure 2:
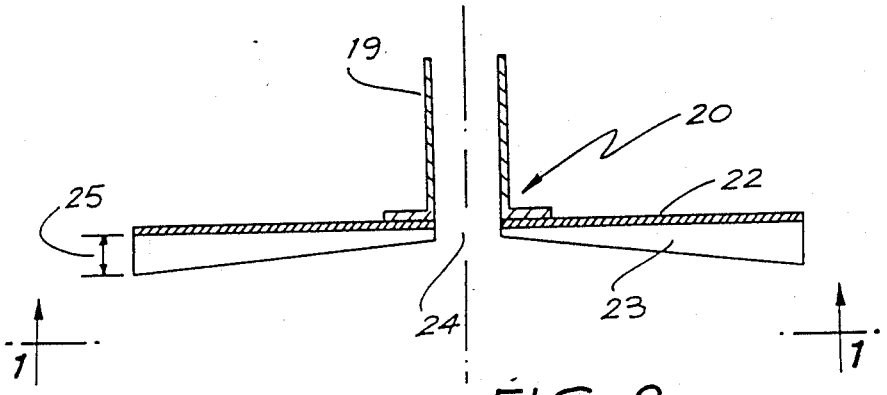
FIG. 2 is a enlarged vertical cross-sectional view of the rotor of the aeration apparatus shown in FIG. 1.

As shown in FIG. 2, the height of the blade preferably increases with transverse distance outward from the axis of the disc 22. Although it is preferable, and simpler, for the height of the blade to increase continuously over the length of the blade it will be realised that a similar benefit or effect could be achieved by increasing the height of the blade with distance from the shaft over at least a significant proportion of the radius of the disc. The height of the blade at the periphery of the disc (25 of FIG. 2) should preferably be smaller than the disc radius. The thickness 26 of the blades (FIG. 3) should preferably be no greater than the blade height 25.

To provide increased efficiency in the operation of the flotation cell, it is desired to configure the blades on the rotor so that the bubbles generated by the rotor are generally very small in size and preferably in the range of 100 to 500 μm. It has been found that this can be determined for a desired speed of rotation of the rotor by determining the blade height at any point along the length of the blade in accordance with the following formula:

$$d_b = \frac{11.89}{U}\left(\frac{\gamma\mu \cdot 2h}{\rho^2 (1 + C_p)}\right)^{\frac{1}{3}}$$

where $d_b$ is the desired bubble diameter U is the velocity.. of the blade through the liquid, generally equal to 2 $\pi$Nr where N is the rotational frequency of the rotor in c.p.s. and r is the radius at any specific point on the blade.

$\gamma$ is the surface tension of the liquid.

$\mu$ is the viscosity of the liquid.

h is the height of the blade.

$\rho$ is the density of the liquid.

$C_p$ is the drag coefficient on the blade (generally having a value of 1 to 2).

(S.I. units are used throughout the formula, e.g. kg, m, s, N, etc.).

If the blade is attached to a rotating disc, it is clear that the velocity U will depend on the radial distance r, i.e. $U=2\pi Nr$ where N = rotational frequency, c.p.s., and r is the radius. Thus in the equation if all else is constant, $$d_b \propto \frac{h^{\frac{1}{3}}}{U} \propto \frac{h^{\frac{1}{3}}}{2\pi Nr}$$

so for constant $d_b$, the ratio $h^{\frac{1}{3}}/r$ should also be constant. In practice it is easiest to design as follows:

(i) choose the bubble size desired (preferably very small ones in the range 100 to 500 μm).

(ii) choose a tip speed $U_{tip}$ from practical experience—based mainly on the wear properties of the materials of construction— in the range 5 to 10 m/s.

(iii) calculate the blade height h which will give the desired bubble size.

(iv) by determining the blade height in accordance with the formula the configuration of the blade will be generally increasing in height from the center of the rotor toward the periphery and should in theory h ave a concave lower edge. In practice it is sufficient to shape the blade so that its height increases linearly toward the outer edge of the impeller as this is simpler to manufacture and has almost the same effect as a blade shaped in accordance with the theoretical formula.

It is also apparent from the formula given above that small bubbles are favoured by a high $C_p$ factor, i.e. high-drag shapes. This is generally achieved by blades of small breadth to height ratio, i.e. where the thickness of the blade is considerably less than the height of the blade.

Using the design criterion given above and taking water as an example of the fluid in the flotation cell, the following constants can be substituted to give an approximate formula for the bubble size.

$\gamma=0.072$ N/m (surface tension) p1 $\rho=1000$ kg/m$^3$ (density)

$\mu=10^{-3}$ Pa-s (viscosity)

and $C_p=1.25$ from measurements, $$\text{thus } d_b = \frac{h^{\frac{1}{3}}}{U}\left(\frac{0.072\times10^{-3}\times 2}{(10^3)^2\, 2.25}\right)^{\frac{1}{3}} \quad (11.89)$$

$$= 4.79\times10^{-3}\frac{h^{\frac{1}{3}}}{U} \text{ meters.}$$

where h is in meters and U is m/s.

In order to give a practical range of values with this formula, it is possible to re-write the formula for practical purposes in the following form.

$$d_b = a\frac{h^n}{U^m}$$

where a is in the range of 2 to $15\times10^{-3}$ n is in the range 0.25 to 1.0 m is in the range 0.7 to 1.3

In this way the size and configuration of the blades on the rotor can be designed to give the required small bubble effect in the flotation cell.

In order to optimize the efficiency of the aeration apparatus and to reduce swirl in the flotation cell to a minimum, it is also desirable to operate the rotor in conjunction with a stator of novel configuration.

Figure 5:
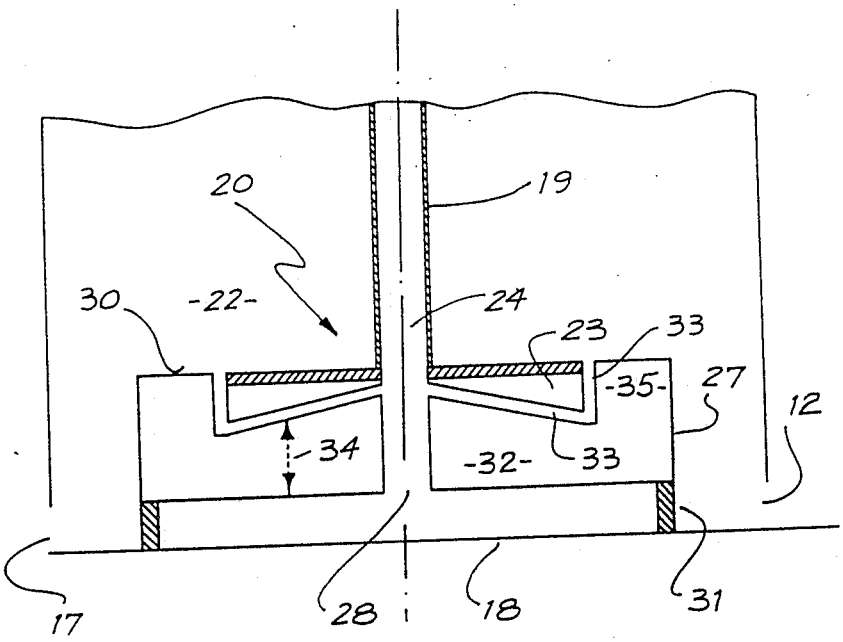
FIG. 5 is an enlarged side elevation of the rotor-stator combination and part of the cell.

Referring to FIGS. 4 and 5, the stator 21 consists of a plurality of vertical blades 27 which extend transversely on lines drawn radially from an axis which is co-axial with the center of the rotor. It is not necessary for the blades to extend to the axis of the rotor-stator system and there could be advantages in manufacturing if a cylindrical opening 28 of approximately the same diameter as the opening 24 in the rotor is provided. The stator is recessed so that the rotor assembly 29 may be placed within it, with the level of the top of the rotor disc 22 being at or below the highest part 30 of the stator. Suitable clearances are necessary between the rotor and the stator, and the stator and the base 18 of the cell. The stator may be mounted on suitably placed posts 31 to raise it off the cell bottom. The part 32 of the stator blade generally beneath the rotor may be shaped to match the slope of the rotor blades at the same radius as shown in FIG. 5, to provide an essentially constant clearance 33 between the rotor and stator. The height 34 of the stator beneath the impeller should preferably be not less than the length of arc 36 between the stator blades in the plane of the rotor top plate (FIG. 4), at the same transverse distance from the rotor axis.

In operation, slurry is drawn by the pumping action of the rotating rotor 20 through the lower part 32 of the stator, and discharges through the upper part 35 of the stator. Air flows into the eye of the rotor 24 and is sucked into vortices which develop at the edges of the blades 23. The production of small bubbles is enhanced by increasing the shear intensity of the vortices, and this intensity is improved by the presence of the vertical stator blades beneath the rotor, which serve to minimize the swirling motion about the rotor axis, of the slurry entering the rotor. After being discharged from the rotor, the mixture of slurry and air bubbles passes into the upper part 35 of the stator where the swirling motion in the discharge flow pattern is essentially eliminated. This is necessary to minimize the formation of swirl vortices in the cell which would disturb the interface between the slurry 14 and the froth 15 and have a deleterious effect on cell performance and operation.

What I claim is:

1. Aeration apparatus for aerating a given liquid, comprising a rotor mounted at the lower end of a hollow drive shaft, means to rotate the rotor, means for receiving and containing such liquid with said rotor immersed therein and with the drive shaft extending substantially vertically upwardly from the rotor, the rotor comprising a disc located in a plane at right angles to the axis of the shaft and having a plurality of blades depending downwardly from the lower face of the disc, the interior of the hollow drive shaft opening to the area beneath the disc such that when the rotor is rotated in the liquid by the drive shaft, and air is forced down the hollow drive shaft to issue on the underside of the rotor, the air is broken up into bubbles by the blades on the rotor, the blades being straight and extending continuously radially outwardly on the underside of the disc from the shaft opening to the periphery of the disc, and the height of the blades increasing continuously with distance from the shaft opening.

2. Aeration apparatus as claimed in claim 1, wherein the height of the blades increases uniformly as a function of distance from the shaft.

3. Aeration apparatus as claimed in claim 1, wherein the height of each blade is determined at every point along the length of the blade and as a function of a desired speed of rotation of the rotor to give a bubble size in range of 100 and 500 μm.

4. Aeration apparatus as claimed in claim 3, wherein the height of the blade is determined by the formula:

$$d_b = \frac{11.89}{U}\left(\frac{\gamma\mu \cdot 2h}{\rho^2 (1 + C_p)}\right)^{\frac{1}{3}}$$

where $d_b$ is the desired bubble diameter U is the velocity of the blade through the liquid, generally equal to 2 $\pi$Nr where N is the rotational frequency of the rotor in c.p.s. and r is the greatest radius of the blade.

$\gamma$ is the surface tension of the liquid.

$\mu$ is the viscosity of the liquid.

h is the height of the blade. $\pi$ is the density of the liquid.

$C_p$ is the drag coefficient on the blade (generally having a value of 1 to 2).

5. Aeration apparatus for aerating a given liquid, comprising a rotor mounted at the lower end of a hollow drive shaft, means to rotate the rotor;

means for receiving and containing such liquid with said rotor immersed therein and with the drive shaft extending substantially vertically upwardly from the rotor, the rotor comprising a disc located in a plane at right angles to the axis of the shaft and having a plurality of blades depending downwardly from the lower face of the disc, the interior of the hollow drive shaft opening to the area beneath the disc such that when the rotor is rotated in the liquid by the drive shaft, and air is forced down the hollow drive shaft to issue on the underside of the rotor, the air is broken up into bubbles by the blades on the rotor, the blades extending continuously outwardly on the underside of the disc from the shaft opening to the periphery of the disc, and the height of the blades increasing continuously with distance from the shaft opening;

wherein the aeration apparatus further comprises a stator mounted at least in part directly below the rotor and said stator includes a plurality of substantially vertical blades extending from an area directly beneath said shaft opening in a direction radially outwardly from said area to a location radially outward of the periphery of the disc.

6. Aeration apparatus as claimed in claim 5, wherein the upper edges of the stator blades correspond with the profile of the lower edges of the rotor blades and said upper edges of said stator blades are spaced a predetermined distance below said lower edges of said rotor blades.

7. Aeration apparatus as claimed in claim 5, wherein the number and thickness of the stator blades approximate the number and thickness of the rotor blades.

8. Aeration apparatus as claimed in claim 5, wherein the stator blades extend radially outwardly beyond the periphery of the disc, and extend upwardly beyond the outer ends of the rotor blades.

* * * * *